United States Patent [19]

Kronenberger et al.

[11] 3,998,069

[45] Dec. 21, 1976

[54] REFRIGERATOR RECEPTACLE SUPPORT AND ADJUSTABLE AIR DEFLECTOR-DRIP TRAY

[75] Inventors: Paul E. Kronenberger, Dayton; Ralph S. Braden, Bellbrook, both of Ohio

[73] Assignee: General Motors Corporation, Detroit, Mich.

[22] Filed: Sept. 18, 1975

[21] Appl. No.: 614,436

[52] U.S. Cl. ..... 62/288; 62/382; 211/126; 211/183; 312/270

[51] Int. Cl.[2] ..... F25D 21/14

[58] Field of Search ..... 62/285, 288, 382; 312/214, 236, 270; 211/126, 183

[56] References Cited

UNITED STATES PATENTS

| | | | |
|---|---|---|---|
| 3,108,455 | 10/1963 | Hanson | 62/382 |
| 3,241,334 | 3/1966 | Amore | 62/382 |
| 3,635,355 | 1/1972 | Kroneberger | 211/183 |
| 3,877,767 | 4/1975 | Bright | 211/126 X |

*Primary Examiner*—William F. O'Dea
*Assistant Examiner*—Ronald C. Capossela
*Attorney, Agent, or Firm*—Edward P. Barthel

[57] ABSTRACT

An adjustable air deflector condensate directing tray and food receptacle shelf support cover for a refrigerator cabinet shelf. The cover includes side flanges, spaced to depend between shelf longitudinal openings, with the flanges having opposed trackways for receiving outwardly flared receptacle top flanges. The tray is releasably retained in the opposed trackways allowing same to initially protrude rearwardly of the removed shelf. Upon the cover and tray being assembled with the shelf and the shelf assembly being installed in the cabinet, tray stop members contact the cabinet rear wall to telescope the tray in the trackways thereby compensating for cabinet liner rear wall out of plane undulations providing a baffle for directing refrigerated air into the receptacle while condensate collected thereon is directed to the cabinet liner rear wall.

4 Claims, 6 Drawing Figures

Fig. 5

REFRIGERATOR RECEPTACLE SUPPORT AND ADJUSTABLE AIR DEFLECTOR-DRIP TRAY

This invention relates to domestic refrigerator cabinet apparatus and more particularly to a removable meat storage receptacle support cover and an adjustable air baffle tray for installation in various locations on a removable refrigerator shelf.

Prior art food storage receptacles or meat-tender containers, are disclosed generally in prior art patents such as the U.S. Pat. No. 3,108,455, issued Oct. 29, 1963, to R. S. Hanson and assigned to the same assignee as the present application. As explained in the Hanson Patent, these receptacles are utilized for the storage of fresh meat cuts, such as steaks and chops, for maintenance at a low but unfrozen temperature in the food storage chamber of a refrigerator cabinet. The Hanson patent receptacle has an inclined air scoop at the back thereof to direct air into the container and also to carry condensate drip water away from the container toward the rear wall of the refrigerator chamber or into a cabinet drain trough.

It is an object of the present invention to provide an improved assembly for supporting a food storage receptacle on a conventional removable shelf within a refrigerator cabinet including a plate-like cover for the receptacle located on the shelf having paired trackways the front portions of which glidably support the receptacle. The trackways also receive an air deflector and condensate drip tray member at their rearward portion such that the tray member is adjustable in the trackways to correctly position itself against the cabinet rear wall for directing the cold air currents emanating from the evaporator for circulation into the covered receptacle while directing the flow of condensed water onto the rear wall of the refrigerator compartment.

It is a further object of the present invention to provide an improved refrigerator meat storage receptacle drawer support and cover assembly whereby the cover overlies a wire shelf with the support including opposed trackways for the drawer depending from the cover between longitudinal shelf wires. The drawer has a longitudinal dimension less than the depth of the shelf so as to permit an adjustable air directing member and condensate drip tray to be slidably positioned at the rearward end of the trackway with the tray located below the shelf whereby the support cover is positively retained on the shelf. The drip tray is located so that it may initially extend a predetermined distance beyond the rear edge of the shelf prior to its insertion into the cabinet such that the tray correctly adjusts itself relative to the cabinet rear wall by means of spaced stop tabs to allow for any manufacturing out of tolerance in the refrigerator cabinet.

Further objects and advantages of the present invention will be apparent from the following description, reference being had to the accompanying drawings wherein a preferred embodiment of the present invention is clearly shown.

Figures 1, 2, 3:
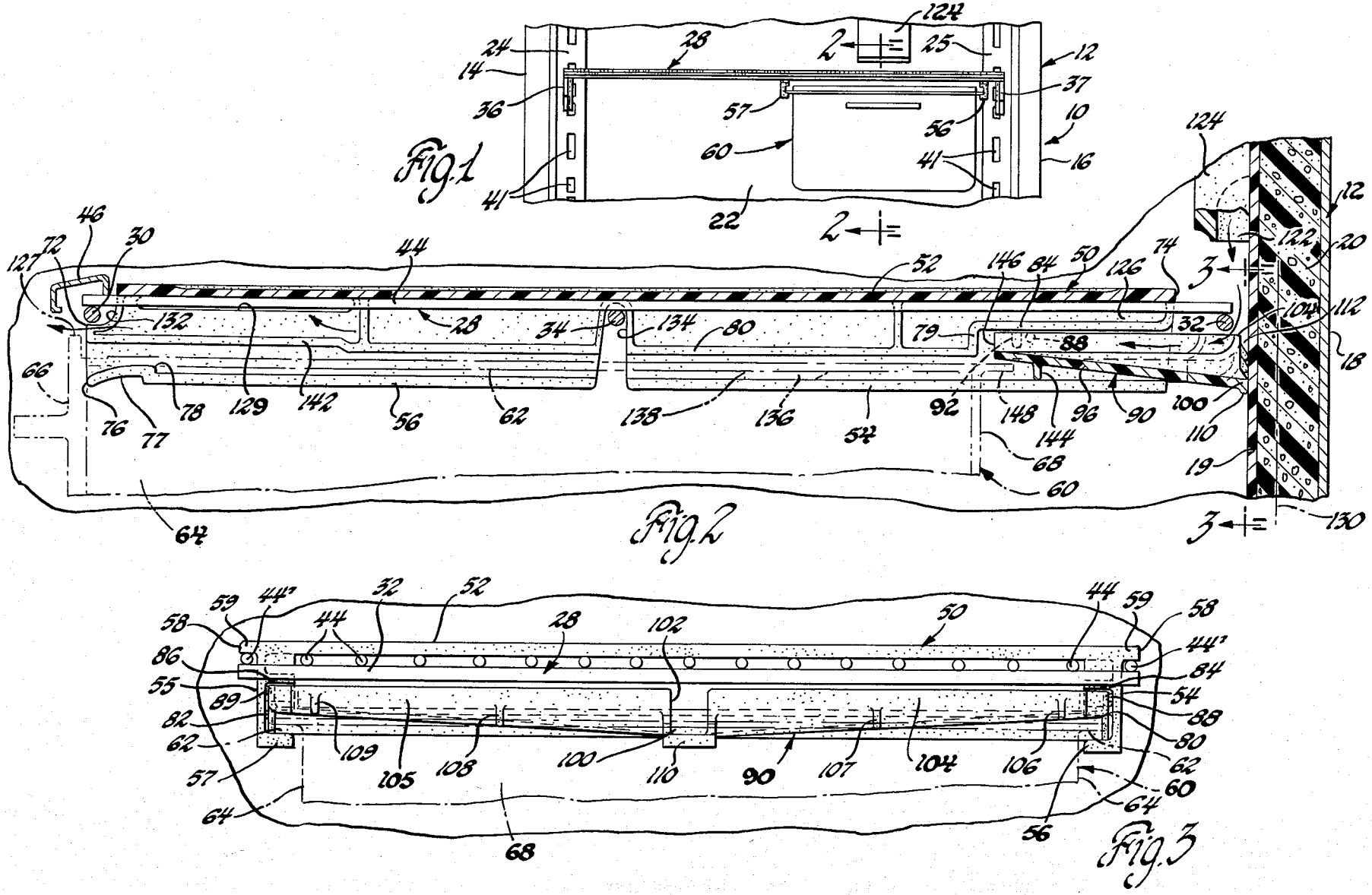
FIG. 1 is a front view of a portion of a household refrigerator cabinet with the access door to the food storage chamber thereof removed, showing the invention incorporated therein.
FIG. 2 is an enlarged fragmentary vertical sectional view through the shelf cover support taken on line 2—2 of FIG. 1.
FIG. 3 is a fragmentary vertical elevational view taken on line 3—3 of FIG. 2.

Referring now to the drawings, for illustrating the invention, there is shown in FIG. 1 thereof a refrigerator cabinet generally represented by the reference numeral 10 having a refrigeration system (not shown) associated therewith. For purposes of the present disclosure a refrigerating system incorporated in cabinet 10 may be of the type fully shown and described in U.S. Pat. No. 3,572,049 issued Mar. 23, 1971, to E. J. Moorman and assigned to the assignee of this application, the disclosure of which is incorporated by reference herein. By reference to this patent the construction of the refrigerating system together with the operation of the system is to be considered a part of the instant disclosure needing no detailed description herein.

The household refrigerator cabinet 10 includes an outer metal shell 12 of rectangular box form including a pair of spaced apart side walls 14, 16 joined by a rear wall 18. The cabinet 10 includes a plastic liner, the back wall of which is shown at 19 in FIG. 2, located in spaced relationship to the outer shell 10 to form a space therebetween which is filled by a foamed-in-place thermal insulating material 20. The cabinet includes a frozen food storage compartment in the upper portion thereof (not shown), and an unfrozen or fresh food storage compartment 22 below the freezing compartment having a front access opening normally closed by a door also not shown.

The chamber rear wall 18 has vertically extending stringers or rails 24 and 25 for supporting vertically spaced apart wire or the like food supporting shelves 28 disposed therein and secured in a cantilever manner to be explained.

Figure 4:
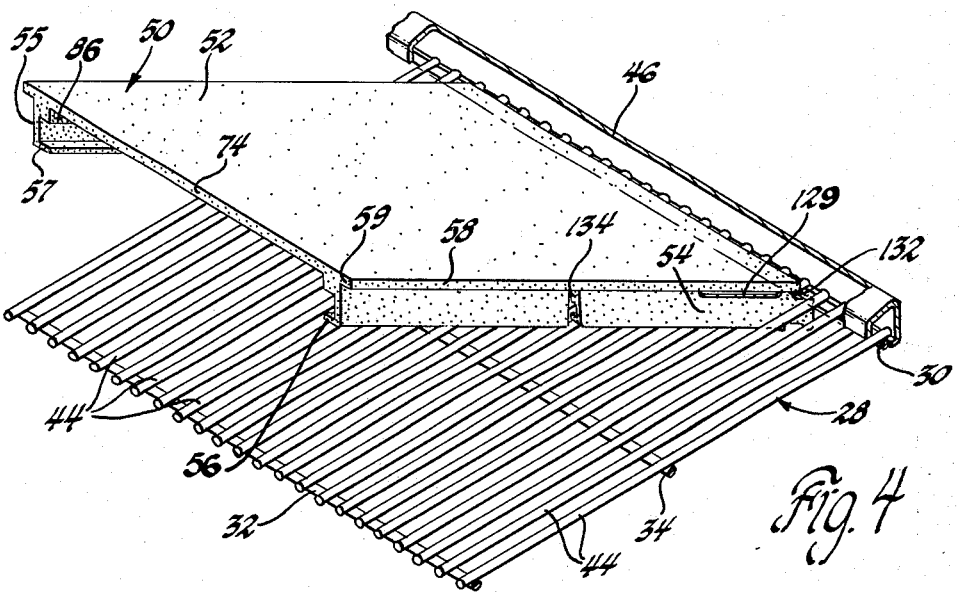
FIG. 4 is a perspective view of the storage receptacle cover support and illustrates the manner in which the member is initially placed in association with a refrigerator shelf.

As best seen in FIGS. 2, 3 and 4, the shelf 28 is preferably of the cantilever type and includes a front transverse bar 30 and a rear transverse bar 32 which like the front bar 30 is of heavy wire. The shelf 28 also includes a central transverse bar 34 of heavy wire parallel to the front and rear bars 30 and 32. A pair of cantilever arms 36 and 37 in the form of wedge-shaped thin plates are fastened to the opposite ends of the bars 30, 32 and 34 and form the sides of the wire shelf 28. For a complete disclosure of the shelf structure reference may be had to the U.S. Pat. No. 3,877,767 issued Apr. 15, 1975, to Bright and assigned to the assignee of the present application, disclosure of which was incorporated by reference herein. As shown in the Bright patent, the cantilever arms are mirror images and each is provided with an upper rear hook and a lower rear hook which extend and hook into adjacent notches or slots 41 in the spaced vertical stringers 24 and 25. The wire shelf 28 also includes a series of uniformly spaced longitudinal wire supports or crossbars 44 parallel to the arms 36 and 37 resting upon and bonded to the transverse bars 30, 32 and 34 to form the main supporting surface of the shelf 28. A front edge strip, preferably in the form of a sheet metal bar 46, is rolled and bent to provide a decorative shelf trim and is welded or otherwise suitably affixed to the crossbars 44 of the shelf.

A receptacle and support cover member 50, preferably molded of a suitable plastic material such as impact polystyrene, is supported on the upper surface of the shelf 28. The support member 50 includes a horizontally disposed cover plate 52 to overlie the shelf top surface. Plate 52 is provided with a pair of integral depending side flanges 54 and 55 defining opposed trackways or guideways formed by inwardly extending return flanges 56 and 57 at the lower edges of the side flanges 54 and 55 respectively. The trackways are positioned a defined distance below the plane of the cover plate 52 with the width of the return flanges 56 and 57 being slightly less than the clear space between adjacent longitudinal crossbars 44 for passage of the pair of return flanges between two of the shelf spaces. As seen in FIG. 3, the depending flanges 54 and 55 are offset inwardly from the edges 58 of plate 52 to provide edge ribs 59 which engage a pair of crossbars outboard of the depending flanges with such crossbars shown at 44'. In the disclosed form of the invention the crossbars 44, which are 0.120 inches in diameter, are spaced on ¾ inch centers to provide a clear space between adjacent crossbars of about ⅝ inch.

The guideways slidably support a drawer type meat tender container or pan member 60 which is preferably integrally molded of plastic material such as acrylic having flanges or lips 62 flared outwardly from top edges of sidewalls 64 so as to be carried or suspended from the opposed trackway 56, 57 of support cover member 50. The drawer or pan member 60 forms with plate 52 the covered receptacle unit. Drawer 60 is glidable relative to the support cover member 50 while supported outwardly of the fresh food compartment 22 as indicated, for example, in the mentioned Hanson patent.

It will be noted in FIG. 2 that the drawer 60 has a longitudinal dimension from its front wall 66 to rear wall 68 less than the overall length of the cover member 50, measured from its forward or front face edge 72 to its rear edge 74, by a predetermined amount to allow for the reception of a combined adjustable air deflector and condensate drip tray member. Thus, with the drawer fully closed such that its front wall 66 contacts the front edge 76 of raised flange tip 77, forming drawer offset stop 78, the drawer rear wall is in substantial vertical alignment with rear offset 79 of support cover trackway upper flange 80. As viewed in FIG. 3 the upper righthand flange 80, integral with left side flange 54, extends parallel to the lower return flange 56 to form the righthand drawer trackway while upper lefthand flange 82, integeral with side flange 55, extends parallel to the lower return flange 57 to form the lefthand drawer trackway. The upper lefthand flange 80, which is a mirror image of righthand flange 82, includes a rear offset upper flange 84 which defines with lower return flange 56 an enlarged rear trackway of predetermined longitudinal extent for the slidable reception of the condensate drip tray member generally indicated at 90 in FIG. 6. A corresponding left hand rear offset upper flange 86 on side flange 55 defines the complementary portion of the enlarged rear trackway.

It will be noted that the inner surface of the side flanges 54 and 55 have formed thereon integral prong protrusions preferably having button-like shape, indicated at 88 and 89, respectively, positioned a predetermined distance from the cover support rear edge 74. The protrusions 88, 89 are adapted to provide pressure engagement of the grooves or troughs 92, formed on the outer surface of the condensate drip tray side walls 94 and 95 (FIG. 6) for a purpose to be described.

Figure 6:
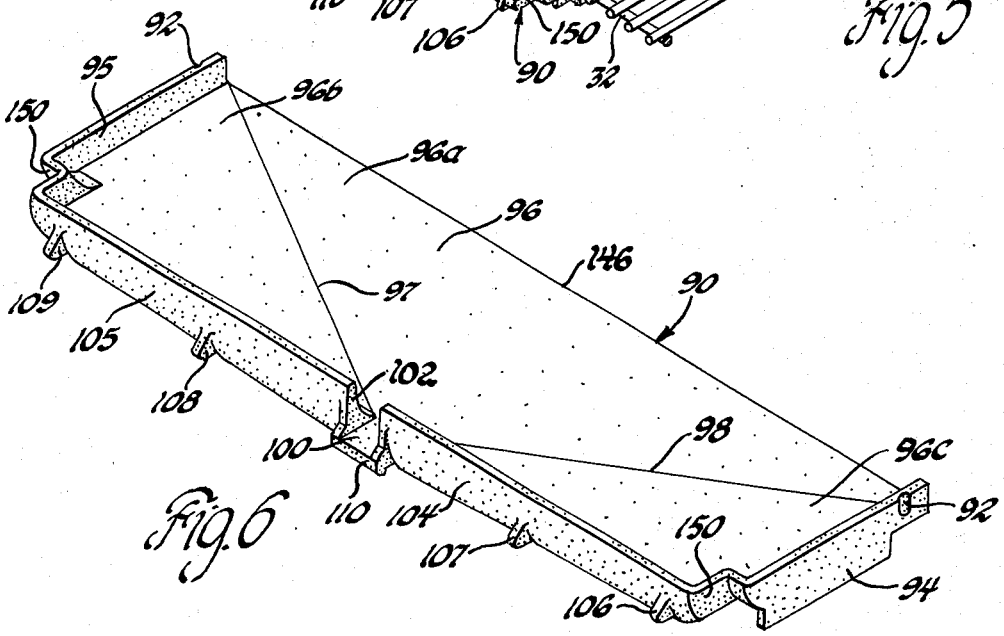
FIG. 6 is an enlarged perspective view of the air directing drip tray of the present invention.

As best seen in FIG. 6 the condensate drip tray side walls 94, 95 are integrally molded with the tray base 96 the upper surface of which is formed with triangular drain surfaces **96*a*, 96*b* and 96*c* defined in part by diagonal intersections 97 and 98 converging at a central tray drain spout portion 100 located at rectangular orifice 102 separating the tray rear wall sections 104 and 105. It will be seen in FIGS. 2 and 6 that each rear wall section 104, 105 is formed with a pair of gauging fins 106, 107 and 108, 109 respectively, the edges of which are adapted to contact the liner back wall 19 in conjunction with the rear lip 110 of drain spout 100. It will be seen in FIG. 2 that when the cover support 50 and tray 90 are assembled and installed in a refrigerator cabinet preferably all four of the fins 106–109 and the lip 110 of the spout 100 lie in the vertical plane of the liner back wall 19** so as to contact same.

By virtue of this arrangement the spout 100 serves to convey condensate drip water, during defrosting periods of the refrigerator, away from the drawer unit onto the liner rear wall 19 for flow downwardly to suitable condensate removal means such as shown, for example, in U.S. Pat. No. 3,696,632 to Carlin et al. In this regard it is important that the drip tray 90 block the downward passage of condensate deposited on the liner rear wall 19 above the drip tray and to this end the fin members 106–109 along with the spout 100 insure that a vertical passage 112 (FIG. 2) is maintained between the tray rear walls 104, 105 and the liner wall 19.

As viewed in FIGS. 1 and 2 another function of the combined air baffle and drip tray is to serve as a scoop or deflector in the path of air egressing from outlet 122 of flue portion of freezer temperature control housing 124 and to direct this air, indicated by the arrows, into passage 126 which allows flow of chilled air into the covered receptacle or pan 60. The air exits the pan through spacing above the top edge 127 of the pan and elongated side openings in depending flanges 54 and 55, one of which is shown at 129 in flange 54. To this end it is critical that the drip tray contact the liner rear wall 19 to insure that the required guantity of air is deflected into the passage 126. An additional consideration encountered in refrigerator cabinet design is caused by a possible undulating condition of the plastic liner rear wall 19 which may occur as a slight outwardly convex, inwardly concave or wavy surface, any one of which may prevent all four stop or spacer fins 106–109 from contacting the liner back wall 19. The effect is that the condensate flow passage 112 may be oversize at one end resulting in a non-uniform or insufficient quantity of chilled air being directed into the storage pan 60.

Applicant has achieved a solution to the problem by designing the drip tray 90 to be retained in the enlarged rear trackway portion, defined by upper flanges 84 and 86, by releasable securing or fastener means, in the form of protrusions 88 and grooves 92, so as to extend rearwardly beyond cover edge 74 a predetermined distance. Thus, upon insertion of the cover 50, tray 90 and shelf 24 assembly into the refrigerator cabinet into its cantilevered supported position the tray rear fins 106–109 and spout lip 110 contact liner wall 19 causing the releasable fastener means 88 and 92 to be disengaged and allowing the tray to slide inwardly into its rear enlarged trackway an amount to compensate for any out of tolerance of the cabinet lower rear wall 19. Also, the dimensional tolerance between the width of tray 90 relative to the transverse spacing of depending side flanges 54 and 55 is such that tray 90 is capable of assuming a slightly skewed orientation relative to the support cover member to allow the tray fins 106–109 to establish contact or be located in juxtaposition with liner rear wall 19 despite any out of planar or slightly bowed condition of the wall 19 as discussed above.

The result is that applicant's baffle and condensate drip tray 90 is automatically positioned to perform both its condensate removal function as well as its chilled air deflecting function without further adjustment once the cantilever shelf, cover support and drip tray assembly are supported in the cabinet. The dashed construction-line 130, seen in FIG. 2, indicates the initial position of the drip tray fin edges and spout lip 110, with fastener means in the form of the bumps 88 received in grooves 92 removably securing the tray 90, prior to the final supporting of the assembly in the cabinet.

Figure 5:
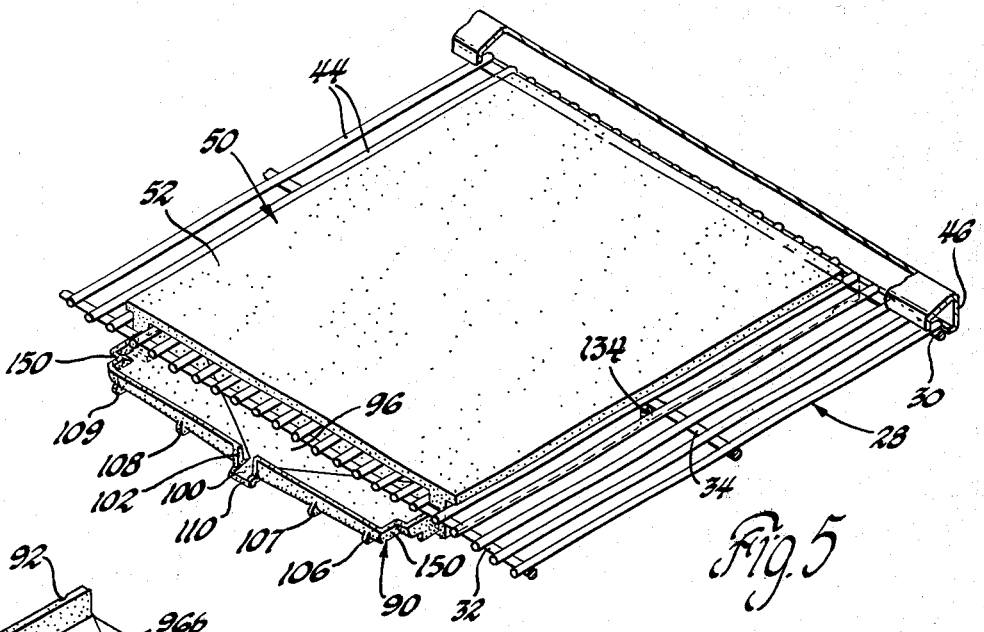
FIG. 5 is a perspective view of the cover support member and air director drip tray assembly embodying the invention in combination with a refrigerator shelf, a portion of which is broken away to show hidden features.

Another feature of applicant's design, shown in FIGS. 4 and 5, involves the locking arrangement between the cover support 50, drip tray 90 and the shelf 28. FIG. 4 shows the cover support 50 being locked onto the shelf by the initial step of inserting the depending flanges 54, 55 into a pair of longitudinal spaces formed by crossbars 44 such that quarter-round grooves 132, formed at the forward upper portion of each of the flanges 54, 55, receive the front transverse bar 30.

As seen in FIG. 5 the cover support member 50 is next rested on the upper surface of the crossbars 44 by means of central transverse bar 34 being received in U-shaped grooves 134 formed in flanges 54 and 55. The drip tray 90 is next inserted in the rear enlarged trackway until paired bumps 88 engage their associated grooves 92 to secure the three pieces 28, 50 and 90 in an interlocked shelf assembly ready for placement in the refrigerator cabinet.

It will be noted in FIG. 2 that the underside of the pan side flanges 62 has integral stop slides 136 which together with the raised flange tips 77 slidably support the pan 60 while the front edge 138 of slide 136 provides a stop upon engagement with offset stop 78. The forward portion 142 of upper flange 80 is offset upwardly to increase the forward trackway spacing so that stop slide 136 clears offset stop 78 thereby enabling the pan 60 to be completely withdrawn from the cover support 50 for removal from the refrigerator cabinet for cleaning or the like. Further, it will be seen in FIG. 2 that the transverse stiffening rib 144 of the tray is positioned a determined distance from the tray forward edge 146 to allow clearance for the rear lip flange 148 of the pan 60.

While it was stated earlier that pan member 60 could be molded of acrylic plastic material, it will also be appreciated that other plastic material such as smoked or light transmission modified acrylic or modified ABS plastic material could be used while the cover member 50 is preferably molded from high impact polystyrene and the tray 90 of ABS plastic material.

As seen in FIG. 6, applicant has provided a notched-out portion 150 at each forward corner of the tray 90 to allow for clearance of the vertical stringers 24 and 25 thereby allowing the pan and cover support assembly to be located adjacent either side wall of the cabinet such as shown in FIG. 1 with the assembly shown located adjacent the cabinet liner right side wall.

While the embodiment of the present invention as herein disclosed constitutes a preferred form, it is to be understood that other forms might be adopted.

We claim:

1. In combination with a refrigerator cabinet having a food storage chamber, a shelf removably mounted in cantilever fashion from the rear wall of the chamber having a plurality of longitudinal extending spaced open areas, a food storage assembly including a drawer and a supporting cover plate member therefor overlying the upper surface of the shelf, said cover plate including integral flange means depending from each side thereof and laterally spaced so as to extend through a pair of the open areas to project from the underside of the shelf, said flange means providing confronting longitudinal extending trackways, means on said drawer in slidable supporting engagement with said trackways, said drawer having a predetermined longitudinal dimension less than said plate member, an air deflector tray in slidable engagement with the rearward portion of said trackways, said tray being vertically spaced from said cover plate to provide an air flow passage therebetween communicating with the interior of the drawer, a plurality of spacer means extending from the rear wall of said tray, releasable means for retaining said tray in said trackways, whereby said tray initially extends rearwardly from the shelf a predetermined dimension such that upon the installation of the shelf on the chamber rear wall certain ones of said tray spacer means engage the chamber rear wall resulting in the disengagement of said releasable means causing telescoping movement of said tray in said trackways to a final position compensating for any undulations in the chamber rear wall, and thereby positioning said tray to direct the required quantity of refrigerated air dispensed to the chamber into the drawer via said air flow passage while said spacer means define a passage to allow condensate on the chamber rear wall to flow downwardly past said tray.

2. In combination with a refrigerator cabinet having a food storage chamber, a shelf removably mounted in cantilever fashion from the rear wall of the chamber having a plurality of shelf rods extending from front to rear defining spaced open areas, a food storage assembly including a drawer and a supporting cover plate member therefor overlying the upper surface of the shelf, said cover plate including integral flanges depending from each side thereof and laterally spaced so as to extend through a pair of the open areas to project from the underside of the shelf, inwardly directed return flanges on each said depending flange providing confronting longitudinal extending trackways, flange means on said drawer in slidable supporting engagement with said trackways, said drawer having a predetermined longitudinal dimension less than said plate member, an air deflector tray in slidable engagement with the rearward portion of said trackways, said tray being vertically spaced from said cover plate to provide an air flow passage therebetween communicating with the interior of the drawer, a plurality of spacer fins extending from the rear wall of said tray, releasable means for retaining said tray in said trackways whereby said tray initially extends rearwardly from the shelf a predetermined dimension, such that upon the installation of the shelf on the chamber rear wall certain ones of said tray spacer fins engage the chamber rear wall resulting in the disengagement of said releasable means causing telescoping movement of said tray in said trackways to a final position conforming to any undulations in the chamber rear wall, allowing said tray to direct refrigerated air dispensed to the chamber into said drawer via said air flow passage while said spacer fins define a space to allow condensate on the chamber rear wall to flow past said tray.

3. In combination with a domestic refrigerator cabinet having an above freezing chamber, a shelf removably mounted in cantilever fashion from the rear wall of the chamber having a plurality of shelf rods extending from front to rear defining spaced open areas, a removable food storage assembly including a drawer and a supporting cover plate member therefor overlying the upper surface of the shelf, said cover plate including integral flanges depending from each side thereof and laterally spaced so as to extend through a pair of the open areas to project from the underside of the shelf, inwardly directed return flanges on each said depending flange providing confronting longitudinal extending trackways, flange means on said drawer in slidable supporting engagement with said trackways, said drawer having a predetermined longitudinal dimension less than said plate member, a combined condensate drip collecting and air deflector tray in slidable engagement with the rearward portion of said trackways, said tray being vertically spaced from said cover plate to provide an air flow passage therebetween communicating with the interior of the drawer, a plurality of spacer fins extending from the rear wall of said tray, releasable means for retaining said tray in said trackways whereby said tray initially extends rearwardly from the shelf a predetermined dimension, such that upon the installation of the shelf on the chamber back wall certain ones of said tray spacer fins engage the chamber back wall resulting in the disengagement of said releasable means causing telescoping movement of said tray in said trackways to a final location allowing said tray to adjust to any undulations in the chamber back wall, thereby positioning said tray to direct refrigerated air dispensed to the chamber into said drawer via said air flow passage while said spacer fins define a passage to allow condensate on the chamber back wall to flow past said tray, said tray including side and rear walls enclosing an upper surface sloped toward said chamber back wall, said tray rear walls including a drain spout portion cooperating with an orifice in said tray rear wall for conveying condensate drip water away from said drawer toward said chamber back wall for gravity flow downwardly thereon.

4. In combustion with a domestic refrigerator cabinet having an above freezing storage chamber, a shelf removably mounted in cantilever fashion from the rear wall of the chamber having a plurality of shelf rods extending from front to rear defining spaced open areas, a removable food storage assembly including a drawer and a supporting cover plate member therefor overlying the upper surface of the shelf, said cover plate including integral flanges depending from each side thereof and laterally spaced so as to extend through a pair of the open areas to project from the underside of the shelf, inwardly directed return flanges on each said depending flange providing confronting longitudinal extending trackways, flange means on said drawer in slidable supporting engagement with said trackways, said drawer having a predetermined longitudinal dimension less than said plate member, an air deflector tray in slidable engagement with the rearward portion of said trackways, said tray being vertically spaced from said cover plate to provide an air flow passage therebetween communicating with the interior of the drawer, a plurality of spacer fins extending from the rear wall of said tray, releasable connection means disposed between said tray and said trackways for retaining said tray in engagement with said trackways, said connection means in the form of slight protrusions on said depending flanges of said cover plate, said protrusions adapted for pressure engagement with groove means on each side wall of said tray, whereby said tray initially extends rearwardly from the shelf a predetermined dimension, such that upon the installation of the shelf on the chamber rear wall certain ones of said tray spacer fins engage the chamber rear wall resulting in the disengagement of said releasable means causing telescoping movement of said tray in said trackways to a final position allowing said tray to adjust in a skewed manner to compensate for any undulations in the chamber rear wall, thereby positioning said tray to direct the required quantity of refrigerated air dispensed to the chamber into said drawer via said air flow passage while said spacer fins define a passage to allow condensate on the chamber rear wall to flow past said tray.

* * * * *

UNITED STATES PATENT AND TRADEMARK OFFICE

CERTIFICATE OF CORRECTION

PATENT NO. : 3,998,069

DATED : December 21, 1976

INVENTOR(S) : Paul E. Kronenberger and Ralph S. Braden

It is certified that error appears in the above-identified patent and that said Letters Patent are hereby corrected as shown below:

Col. 4, line 27, after "90" insert -- not --; line 44, "guantity" should read -- quantity --.

Col. 8, line 4, "combustion" should read -- combination --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*